United States Patent [19]

McMullen et al.

[11] Patent Number: 4,664,763

[45] Date of Patent: May 12, 1987

[54] PROCESS FOR STRIPPING NICKEL OR NICKEL-ALLOY PLATING IN A CHROMIC ACID SOLUTION

[75] Inventors: Warren H. McMullen, East Brunswick, N.J.; William T. Walling, Lewisville, Tex.

[73] Assignee: M&T Chemicals Inc., Woodbridge, N.J.

[21] Appl. No.: 731,818

[22] Filed: May 8, 1985

[51] Int. Cl.[4] ..... C25F 5/00

[52] U.S. Cl. ..... 204/146

[58] Field of Search ..... 204/146

[56] References Cited

U.S. PATENT DOCUMENTS

| | | | |
|---|---|---|---|
| 2,561,222 | 7/1951 | Passal | 204/146 |
| 3,912,603 | 10/1975 | Mietens | 204/146 |
| 4,356,069 | 10/1982 | Cunningham | 204/146 |

FOREIGN PATENT DOCUMENTS

| | | | |
|---|---|---|---|
| 13666 | of 1908 | United Kingdom | 204/146 |

OTHER PUBLICATIONS

Plating, Aug., 1965, pp. 768–770.

*Primary Examiner*—T. M. Tufariello

*Attorney, Agent, or Firm*—S. Parker; J. Matalon; R. Bright

[57] ABSTRACT

A process for stripping a deposit comprising nickel or a nickel-iron alloy from a substrate metal which comprises immersing the substrate metal with deposit thereon into a stripping bath comprising an aqueous stripping solution comprising chromic acid, utilizing said substrate metal as either or both the anode and cathode of an electrolytic stripping cell and applying an alternating current across the electrodes for a time sufficient to strip the deposit from the substrate metal is disclosed.

31 Claims, No Drawings

PROCESS FOR STRIPPING NICKEL OR NICKEL-ALLOY PLATING IN A CHROMIC ACID SOLUTION

FIELD OF THE INVENTION

This invention relates to the stripping of electroplated nickel and nickel-iron alloys as well as electroless nickel plate from a metal substrate. More particularly, it relates to the use of an alternating current and a chromic acid solution in a stripping process.

BACKGROUND OF THE INVENTION

It is frequently desirable to recover metal substrates which have been electroplated with nickel or iron nickel alloys, especially when the plating is defective. Similarly, it becomes desirable from time to time to strip electroplating from clamping devices and frames used in the electroplating of base metals, e.g., steel. The recovery of such plated metal substrates or stripping of clamps, frames and other plating bath equipment has been hampered by the inability to obtain adequate stripping without excessive etching of the metal being stripped.

U.S. Pat. No. 3,912,603 discloses a method for stripping electroplating from steel which comprises the use of alkali metal or ammonium iodides, preferably the iodides which are difficult to solubilize, such as copper-I-iodide. The stripping bath contains nitric acid or its salts, e.g., alkali metal, ammonium or organic amine salts. The stripping operation is carried out at a pH of about 6.5 to 7.5.

U.S. Pat. No. 4,048,006 discloses a method for stripping electroplated nickel-iron alloys from a metal substrate using a nitro substituted organic compound in combination with an aliphatic carboxylic acid or salts thereof which contain at least one substituent which is —$NH_2$ or quaternay amine salt, —OH or —SH and at least one organic amine or polyamine or substituted analogs thereof. The process is advantageously carried out at elevated temperatures, e.g., 60° C. to 90° C. at a pH below 7. The process can be carried out with nickel-iron alloy deposits which contain minor amounts of impurities such as zinc, cadmiun, lead, etc.

U.S. Pat. No. 4,261,804 discloses a method for stripping nickel alloys from ferrous substrates which utilize specific voltage conditions to strip the nickel alloys from the substrate without damage to the substrate metal.

U.S. Pat. No. 4,052,451 discloses a composition and process for the selected stripping of nickel-iron alloys from ferrous substrates which comprises contacting the metal surface with an aqueous solution containing at least one nitro substituted compound, at least one organic amine or polyamine and substituted analogs thereof, and at least one phosphorous compound which is a phosphorous oxo acid or organic phosphorous oxo acid or salts thereof or alkyl phosphonate substituted amines.

U.S. Pat. No. 4,233,124, and a related patent, U.S. Pat. No. 4,264,420, disclose an electrolytic bath composition and process for stripping metal deposits from a different substrate metal. The composition comprises an aqueous solution containing activating halogen compounds, an amine, nitro and/or nitrate stripping components. Additionally, an inhibiting agent to inhibit attack on the substrate metal comprising glucoheptonic acid, malic acid and mixtures thereof as well as the Groups IA, IIA and ammonium salts is included in the composition. The halogen containing compounds are preferably bromine compounds which liberate bromine ions to accelerate the stripping action. A carboxylic acid buffering agent is used to control pH.

In an article appearing in *Transactions of the Institute of Metal Finishing,* 1981, Vol. 59, pp. 110–112, entitled "Electrolytic Stripping of Nickel and Other Metal Coatings From Steel Substrates" by J. O'Grady, a method for stripping nickel alloys from steel substrates is disclosed wherein the stripping agent is ammonium nitrate and carboxylic acids are used to inhibit attack of the substrate metal. The process is carried out at a pH of about 4.5 to about 6.5.

Invariably, prior art techniques have utilized direct current in the stripping process which is consistent with the manner in which the electroplating was initially deposited. Prior art methods of stripping nickel and nickel-iron alloys from a substrate metal have generally resulted in excessive etching of the substrate metal.

SUMMARY OF THE INVENTION

It has surprisingly been found that nickel or iron containing nickel alloys as well as nickel-phosphorous alloys can be stripped from a base metal particularly a ferrous metal such as steel using an alternating current and a chromic acid bath as the stripping solution. Optionally, iodide or iodate salts, boric acid and wetting agents can be included in the stripping bath. A preferred wetting agent is tetraethylammonium perfluorooctane sulfonate. An alternating current of preferably less than 18 volts is utilized at about 5 to about 500 ampers per square foot for a time sufficient to strip substantially all of the nickel or nickel-iron alloy from the substrate metal.

DETAILED DESCRIPTION

This invention relates to a method and composition for the electrolytic stripping of nickel and nickel-iron alloys as well as nickel-phosphorous alloys deposited by electroless nickel plating techniques from a substrate metal particularly a ferrous metal such as steel. In particular, it relates to a stripping method which uses an aqueous solution of chromic acid as the stripping solution. Another aspect of the invention is the use of alternating current rather than direct current in the stripping process. As used in the specification and claims, the term "nickel compound" means nickel and nickel-iron alloys used in electroplating as well as the nickel-phosphorous alloys deposited by electroless nickel plating.

A particularly unique aspect of the invention is that since alternating current is utilized, both the anode and cathode of the stripping unit can be the substrate from which the nickel compound is to be stripped. This is in contrast to the prior art stripping processes where the substrate metal from which the nickel compound is to be stripped is made the anode and another metal, e.g., stainless steel, is used as the cathode. The result is a higher throughput of work for the same size stripping unit.

In carrying out the process of this invention, the chromic acid stripping solution comprises an aqueous solution of about 10 to about 1000 grams of chromic acid per liter, preferably about 100 to about 800 grams per liter, more preferably about 200 to about 700 grams per liter, most preferably about 300 to about 600 grams per liter, e.g., 400 to 500 grams per liter. Optionally, the chromic acid solution can contain an iodide, an iodate or boric acid to prevent pitting in high current density areas, e.g., the edge of the specimen to be stripped. The preferred iodides or iodates are alkali metal iodides or iodates. However, any water soluble iodide or iodate can be utilized.

Illustrative, non-limiting examples of suitable iodine compounds which can be used in the practice of this invention include quaternary ammonium iodide salts, e.g., trimethyl benzyl ammonium iodide; sodium iodide, sodium iodate, potassium iodide, potassium iodate, ammonium iodide, ammonium iodate, lithium iodide, lithium iodate, etc. As used in the specification and claims, the term "iodine compound" means a water soluble iodide or iodate salt. The iodine compounds of this invention are utilized at a concentration of about 1 to about 15 grams per liter, more preferably about 2 to about 10 grams per liter, e.g., about 4 to about 8 grams per liter.

When boric acid is utilized as the pitting inhibitor, it is used at a concentration in the stripping solution at about 1 to about 50 grams per liter, preferably about 5 to about 45 grams per liter, more preferably at about 10 to about 40 grams per liter, e.g., about 20 to about 30 grams per liter. The term "pitting inhibitor," as used in the specification and claims, means the iodine compounds of this invention and boric acid. The preferred pitting inhibitors are the iodine compounds of this invention, e.g., potassium iodide.

In one embodiment of this invention, the chromic acid stripping solution contains a surfactant which acts as a fume suppressor. During the stripping operation, gases are formed which cause splattering and fuming as they escape from the stripping bath. When a surfactant is present, the escaping gas bubbles generate a foam which blankets and stripping bath and controls fuming. Preferably, the surfactant is present in the chromic acid stripping bath at about 0.05 to about 0.15 grams per liter, more preferably about 0.2 to about 0.10 grams per liter. Any water soluble surfactant which is a good foamer can be utilized. The preferred surfactants are perfluorinated compounds, e.g., tetra ethyl ammonium perfluorooctane sulfonate. Illustrative, non-limiting examples of surfactants suitable for use in this invention include sodium monodidodecyl disulfonate diphenyl oxide, alkyl benzimidazol, tetraethyl-ammonium perfluorooctane sulfonate.

The only consideration in determining the voltage to be used in carrying out the stripping operation is safety. While any voltage can be used, it is preferred that the voltage be less than 20 volts, preferably less than 18 volts, more preferably about 2 to about 10 volts. Similarly, the current density is not critical. However, a current density of about 5 to about 500 amperes per square foot (ASF) is preferred, more preferably the current density is about 25 to about 200 ASF, most preferably, 40 to about 120 ASF, e.g., 50 to 100 ASF. At higher current densities, areas of high current density on the work piece, e.g., edges, may become pitted. This pitting can be avoided by the use of shields known in the art to protect such high current density areas.

While any convenient temperature can be used to carry out the stripping operation, a suitable operating temperature range is about room temperature, i.e., 70° F., to about 150° F., preferably about 100° F. At the higher temperatures, stripping is accomplished at a faster rate. However, etching of the substrate metal can occur at temperatures significantly above 150° F.

The time to complete the stripping process will depend on the amount of material to be stripped as well as the voltage, current density and temperature used in conducting the stripping process. Generally, the stripping operation can be accomplished in about 30 minutes to about 24 hours.

In carrying out the stripping operation of this invention, it is preferred that the soluble iron content of the chromic acid solution be less than 15 grams per liter. At higher concentrations ion build-up results in higher voltage requirements.

The advantages of the instant invention may be more readily appreciated by reference to the following Examples.

EXAMPLE I

Steel substrates having deposited therein electroplated nickel or nickel-iron alloy were stripped using the process of this invention utilizing an aqueous stripping solution comprising 480 grams per liter of chromic acid. The samples had an area of about 1/50 of a square foot. A current density of 50 ASF for 1 hour was used. The test samples were used as both the anode and cathode of the stripping operation. The results are shown in Table I.

TABLE I

STRIPPING OF NI AND NI—FE ALLOYS USING ALTERNATING CURRENT AND A CHROMIC ACID STRIPPING BATH

| ELECTROPLATE DEPOSIT | COMPOSITION (wt %) | STRIPPING CURRENT (ASF) | STRIPPING RATE (Mg/hr) 75° F. | 120° F. | 150° F. |
|---|---|---|---|---|---|
| Ni | 100 | 50 | 342 | 495 | 560 |
| Ni/Fe | 70/30 | 50 | 183 | 346 | 420 |
| Ni/Fe | 45/55 | 50 | 134 | 206 | 300 |

It is apparent that effective strip occurs at a commercially acceptable rate. As temperature was increased, the stripping rate increased. The higher the iron content of the deposit to be stripped, the lower the stripping rate. No etching of the substrate was observed.

EXAMPLE II

Example I was repeated using a current density of 100 ASF. The results are shown in Table II.

TABLE II

STRIPPING OF NI AND NI—FE ALLOYS USING ALTERNATING CURRENT AND A CHROMIC ACID STRIPPING BATH

| ELECTROPLATE DEPOSIT | COMPOSITION (wt %) | STRIPPING CURRENT (ASF) | STRIPPING RATE (Mg/hr) 75° F. | 120° F. | 150° F. |
|---|---|---|---|---|---|
| Ni | 100 | 100 | 708 | 940 | 1116 |
| Ni/Fe | 70/30 | 100 | 352 | 576 | 720 |
| Ni/Fe | 45/55 | 100 | 240 | 372 | 468 |

As was expected increasing the current density increases the stripping rate. Where the deposit to be stripped is 100% nickel there appears to be a 1:1 correlation between current density to stripping rate, e.g., doubling the current density doubles the stripping rate. No etching of the substrate was observed.

What is claimed is:

1. A process for stripping a deposit comprising nickel or a nickel-iron alloy from a ferrous substrate metal which comprises immersing the substrate metal with deposit thereon into a stripping bath comprising an aqueous stripping solution comprising chromic acid, utilizing said substrate metal as either or both the anode and cathode of an electrolytic stripping cell and applying an alternating current across the electrodes for a time sufficient to strip the deposit from the substrate metal.

2. The process according to claim 1 wherein the substrate metal to be stripped is utilized as both the anode and cathode of the stripping cell.

3. The process according to claim 1 wherein the stripping solution comprises about 10 to about 1000 g/l of chromic acid.

4. The process according to claim 3 wherein the solution comprises about 200 to 700 g/l of chromic acid.

5. The process according to claim 1 wherein the ferrous substrate metal is steel.

6. The process according to claim 1 wherein the deposit is a nickel-iron alloy.

7. The process according to claim 1 wherein the alternating current is applied to the electrodes of the stripping cell at a current density of about 5 to about 500 amperes per square foot.

8. The process according to claim 7 wherein the current density is about 25 to about 200 amperes per square foot.

9. The process according to claim 7 wherein the current density is about 40 to about 120 amperes per square foot.

10. The process according to claim 7 wherein the ferrous substrate metal is steel and the deposit is a nickel-iron alloy.

11. The process according to claim 1 wherein a pitting inhibitor is incorporated into the chromic acid stripping bath solution.

12. The process according to claim 11 wherein the pitting inhibitor is boric acid.

13. The process according to claim 12 wherein the boric acid is incorporated into the stripping solution at about 1 to about 50 grams per liter.

14. The process according to claim 12 wherein the boric acid is incorporated into the stripping solution at about 5 to about 45 grams per liter.

15. The process according to claim 12 wherein the ferrous substrate metal is steel.

16. The process according to claim 15 wherein the deposit is a nickel-iron alloy.

17. The process according to claim 11 wherein the pitting inhibitor is an iodine compound.

18. The process according to claim 17 wherein the iodine compound is utilized at a concentration of about 1 to about 15 grams per liter of stripping solution.

19. The process according to claim 17 wherein the ferrous substrate metal is steel and the deposit is a nickel-iron alloy.

20. The process according to claim 17 wherein the iodine compound is utilized in the stripping solution at about 4 to about 8 grams per liter.

21. The process according to claim 17 wherein the iodine compound is sodium iodide, potassium, iodide, sodium iodate, potassium iodate, ammonium iodide or ammonium iodate.

22. The process according to claim 21 wherein the iodine compound is potassium iodide.

23. The process according to claim 1 wherein the stripping bath is maintained at a temperature of about 70° F. to about 150° F.

24. The process according to claim 1 wherein a surfactant is incorporated into the chromic acid solution.

25. The process according to claim 24 wherein the surfactant is a perfluoronated compound.

26. The process according to claim 25 wherein the perfluoronated compound is tetra ethyl ammonium perfluorooctane sulfonate.

27. The process according to claim 24 wherein the surfactant is sodium monodidodecyldisulfonate diphenyloxide or an alkylbenzimidazol.

28. The process according to claim 24 wherein the surfactant is utilized in the chromic acid solution at a concentration of about 0.05 to about 0.15 g/l of solution.

29. The process according to claim 24 wherein the surfactant is utilized in the chromic acid solution at a concentration of about 0.10 g/l of solution.

30. A process for stripping a deposit comprising a nickel compound from a ferrous substrate metal which comprises:

(A) immersing the substrate metal with the deposit thereon into a stripping bath comprising an aqueous solution of
  (a) about 10 to about 1000 g/l of chromic acid, based on the weight of the solution, and
  (b) a minor amount of a pitting inhibitor selected from the group consisting of (1) boric acid utilized at a concentration of about 10 to about 40 g/l of solution and (2) an iodine compound utilized at a concentration of about 4 to about 8 g/l of solution;

(B) utilizing said substrate metal as either or both the anode or cathode of an electrolytic stripping cell containing the stripping solution; and (C) applying an alternating current across the electrodes at a current density of about 40 to about 120 amperes per square foot for a time sufficient to strip the deposit from the substrate metal.

31. The process according to claim 30 wherein the iodine compound is potassium iodide.

* * * * *